US005251392A

United States Patent [19]

McManigal

[11] Patent Number: 5,251,392

[45] Date of Patent: Oct. 12, 1993

[54] ARTIFICIAL WINDOW

[75] Inventor: Paul G. McManigal, Newport Beach, Calif.

[73] Assignee: Vemco Corporation, San Dimas, Calif.

[21] Appl. No.: 652,779

[22] Filed: Feb. 8, 1991

[51] Int. Cl.[5] ..... B44F 1/06

[52] U.S. Cl. ..... 40/427; 40/436; 40/442; 40/455; 40/546; 40/564; 362/276; 362/282

[58] Field of Search ..... 40/152.2, 427, 436, 40/432, 442, 455, 546, 547, 564; 362/223, 276, 282

[56] References Cited

U.S. PATENT DOCUMENTS

| | | | |
|---|---|---|---|
| 502,991 | 6/1894 | Howard . | |
| 920,593 | 5/1909 | Leslie . | |
| 1,346,705 | 7/1920 | Gibson . | |
| 1,350,054 | 8/1920 | Baker | 40/432 X |
| 1,429,802 | 9/1922 | Thompson . | |
| 1,520,729 | 12/1924 | Stoewsand . | |
| 1,525,309 | 2/1925 | Lund . | |
| 1,546,089 | 7/1925 | Leachman et al. . | |
| 1,607,922 | 11/1926 | Schweitzer . | |
| 1,652,636 | 12/1927 | Paul . | |
| 1,725,230 | 8/1929 | Ulrich . | |
| 1,804,651 | 5/1931 | Shipman . | |
| 1,820,912 | 9/1931 | Kelly . | |
| 1,846,533 | 2/1932 | Thompson . | |
| 1,882,647 | 10/1932 | Kanolt . | |
| 1,930,359 | 10/1933 | Hilgenberg | 40/442 |
| 2,043,193 | 6/1936 | Dunn et al. . | |
| 2,062,887 | 12/1936 | Karst . | |
| 2,107,641 | 2/1938 | Malcomson . | |
| 2,163,763 | 6/1939 | Ray . | |
| 2,197,965 | 4/1940 | Booth . | |
| 2,323,059 | 6/1943 | Land . | |
| 2,487,403 | 11/1949 | Wisdom | 40/152.2 |
| 2,522,812 | 9/1950 | Bonnet . | |
| 2,523,290 | 9/1950 | Gardner . | |
| 2,567,561 | 9/1951 | Hoffmann | 362/223 |
| 2,634,530 | 4/1953 | Herschede et al. . | |
| 2,653,313 | 12/1952 | Fuchs . | |
| 2,654,827 | 10/1953 | Pierce . | |
| 2,702,440 | 2/1955 | Marchand . | |
| 2,814,895 | 12/1957 | Flam . | |
| 2,824,399 | 2/1958 | Neugass . | |
| 2,861,173 | 11/1958 | Nordquist . | |
| 2,902,787 | 9/1959 | Cook . | |
| 3,024,701 | 3/1962 | Marks et al. . | |

(List continued on next page.)

FOREIGN PATENT DOCUMENTS

| | | | |
|---|---|---|---|
| 413323 | 8/1910 | France . | |
| 587965 | 9/1924 | France | 40/427 |
| 111672 | 9/1925 | Switzerland | 40/427 |
| 9014782 | 12/1990 | World Int. Prop. O. | 40/427 |

OTHER PUBLICATIONS

*Home Mechanix*, Feb. 1988, "Window Mirror", p. 20.

*Primary Examiner*—Kenneth J. Dorner
*Assistant Examiner*—Brian K. Green
*Attorney, Agent, or Firm*—William W. Haefliger

[57] ABSTRACT

An artificial window comprises a box having a rear wall, and walls bounding an interior space which faces longitudinally forwardly; sheet structure extending laterally crosswise of the space, and a viewable pattern associated with the sheet structure to be illuminated by light passing forwardly from the box interior; first and second light sources in the box; a reflector structure in the box to reflect light from the first source in a direction toward the sheet structure for effecting illumination of the viewable pattern; and there being control structure for controlling the illumination of the viewable pattern to independently, differentially, and progressively change the illumination of the viewable pattern.

25 Claims, 4 Drawing Sheets

U.S. PATENT DOCUMENTS 3,054,204 9/1962 Yates .
3,124,639 3/1964 Kahn .
3,184,594 5/1965 Siegel .
3,271,568 9/1966 Lundberg .
3,277,597 10/1955 Trame ..... 40/436
3,289,342 12/1966 Gibson, Jr. .
3,294,964 12/1966 Schwartz .
3,324,290 6/1967 Lasker .
3,350,982 11/1967 Marks .
3,492,486 1/1970 Bischoff et al. .
3,602,590 8/1971 Lukens .
3,629,965 12/1971 Heindl, Jr. .
3,688,424 9/1972 Von Zanten .
3,755,664 8/1973 Reiback .
3,771,245 11/1973 Mabrey et al. .
3,829,998 8/1974 Flax .
3,997,991 12/1976 Hayman-Chaffey et al. .
4,021,949 5/1977 Niehaus et al. .
4,034,494 7/1977 Lane .
4,071,748 1/1978 Dey .
4,118,111 10/1978 Laesser .
4,123,141 10/1978 Schuler .
4,132,464 1/1979 Maeno .
4,185,407 1/1980 Lamb .
4,206,501 6/1980 Brooks .
4,244,130 1/1981 Frois .
4,261,125 4/1981 Rappaport .
4,267,489 5/1981 Morohashi .
4,318,163 3/1982 Bryan .
4,386,476 6/1983 Schulman .
4,414,767 11/1983 Staton .
4,418,378 11/1983 Johnson .
4,469,726 9/1984 Niinivuo .
4,475,298 10/1984 Munoz .
4,531,339 9/1985 Whitehead .
4,587,754 5/1986 Ossner .
4,631,675 12/1986 Jacobsen et al. ..... 362/276 X
4,637,150 1/1987 Geluk .
4,649,462 3/1987 Dobrowolski et al. .
4,901,461 2/1990 Edwards et al. ..... 362/276 X
4,922,384 5/1990 Torrence .
5,069,876 12/1991 Oshinsky ..... 40/407 X

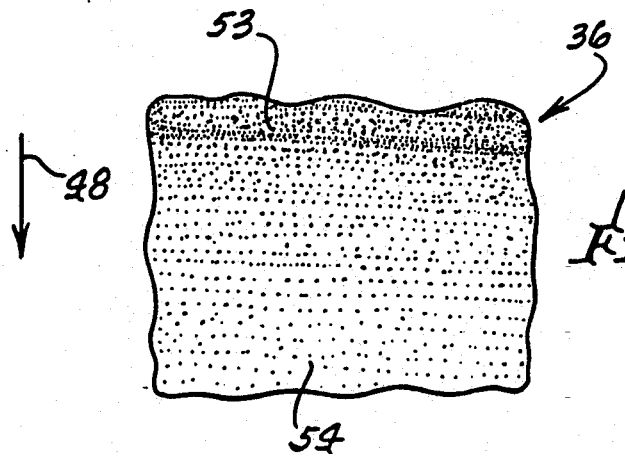
FIG. 5.
FIG. 6.
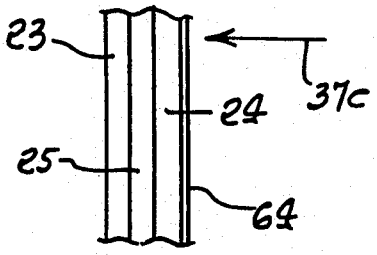
FIG. 7.
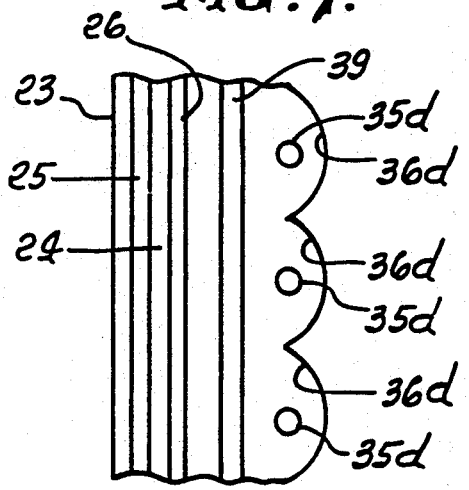
FIG. 9.
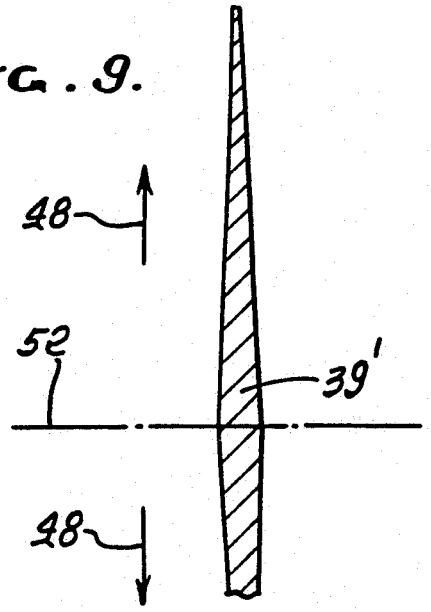
FIG. 8.
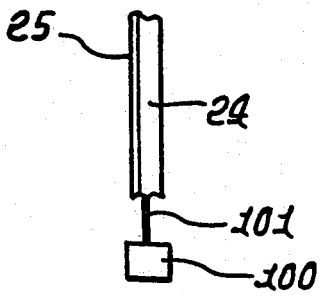

ARTIFICIAL WINDOW

BACKGROUND OF THE INVENTION

This invention relates generally to artificial windows, and more particularly, to improvements in the construction operation of such devices.

It is known to provide so-called artificial windows wherein a scene or picture produced on a film or transparency is illuminated as from the rear side thereof, whereby a viewer in a building can observe the scene or pictures which appear similar to the viewed exterior. A "window" effect is thereby created, and external light has been used for this purpose.

There is need for such improvements in such artificial windows which can enhance the realism of the scene portrayed, and using a local light source or sources. For example, there is need to arbitrarily change the lighting of the viewed transparency to simulate morning, full day, evening, or nighttime conditions. Other realistic effects associated with the portrayed scene are also desirable.

SUMMARY OF THE INVENTION

It is a major object of the invention to provide an artificial window construction or constructions which meet the above need. Basically, the apparatus of the invention comprises:

a) a box having a rear wall, and side walls bounding an interior space which faces longitudinally forwardly, b) translucent sheet means extending laterally crosswise of the space, and viewable pattern means associated with the sheet means to be illuminated by light passing forwardly from the box interior, c) light source means in the box, d) there being means associated with at least one of a), b) and c) for controlling the illumination of the viewable pattern means, as a function of at least one lateral dimension of the one of a), b) and c).

As will appear, the d) means may include means providing substantial uniformity of illumination of the sheet means.

It is another object of the invention to provide means, as in d) above, for illuminating edges of the sheet means in such manner as to highlight special viewable effects associated with the frontwardly portrayed scene on the transparency, as for example simulated stars, as well as sunrise and sunset sky coloration. These effects may be made to change with time. As will be seen, sun and moon effects can be simulated by use of a light pipe or pipes illuminated to produce a bright spot or spots which moves across the sky portion of the transparency or scene portrayed in the artificial window.

Yet another object is the provision of means associate with the light source means for producing viewable effects, such as lights and changes thereof; scene illumination intensity and coloration; and day to night and night to day changes, such as sunset, dawn, rain effects, etc. Light filters, shutters, and dimmers are usable for these purposes. Reproduction of movement of outside lights is also contemplated. In this regard, the box may be supported so that the viewable pattern or scene is viewable from a position inside a building, the pattern defining a picture.

Further objects include means for producing detectable sound and scent effects associated with the illuminated scene in the artificial window Controlled air flow, as from the artificial window, is also contemplated, i.e., to simulate wind or weather conditions. Horizon level change may also be provided, as is characteristic of viewing the horizon from a ship.

As will be seen, the means providing substantial uniformity of illumination of the referenced sheet means may typically include one or more of the following:

- reflecting structures shapes to enhance illumination of lesser illuminated portions of the pattern means,
- variable light-absorbing zones associated with the sheet means,
- variable shading of the pattern means, on a transparency,
- variable thickness of said sheet means that comprises a diffuser, or use of a separate diffuser.

These and other objects and advantages of the invention, as well as the details of an illustrative embodiment, will be more fully understood from the following specification and drawings, in which:

DRAWING DESCRIPTION

FIG. 3*a* is a view showing external structure associated with FIG. 3 structure;

FIG. 5 is a plan view of illumination modifier means;

FIG. 6 is a fragmentary view of multiple sheets;

FIG. 7 is a fragmentary view of a multiple reflector arrangement;

FIG. 8 is a view showing displacement of two sheets;

FIG. 9 is a view of a modified diffuser;

DETAILED DESCRIPTION

Figure 1:
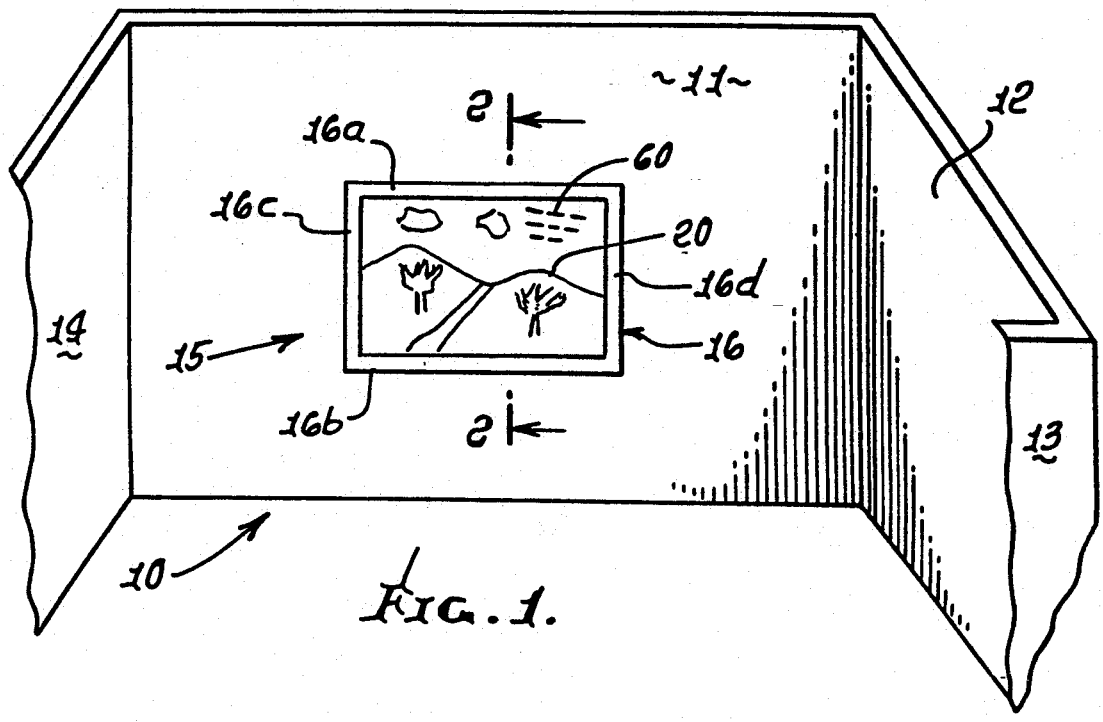
FIG. 1 is a perspective view of a building room, with an artificial window installed on one wall.
Figure 2:
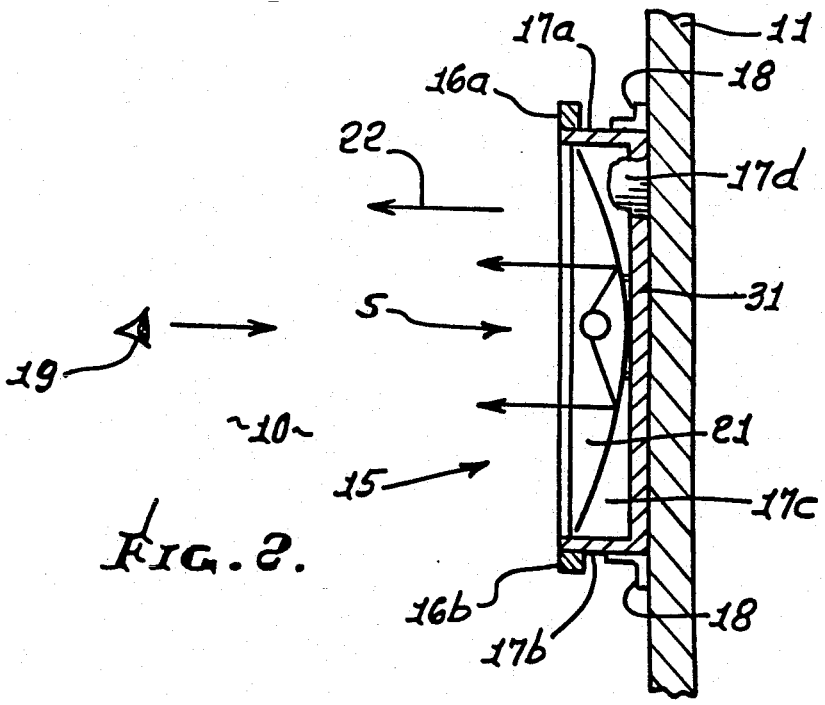
FIG. 2 is an enlarged section taken on lines 2—2 of FIG. 1.

In FIGS. 1 and 2, a room 10 is defined by walls 11–14 of a building or house. Installed on wall 11 is an "artificial window" 15, which appears to show an external scene, such as might exist at the outer side of wall 11. One such scene appears at 20 in the artificial window 15 Note for example the depicted road, trees, sky, and clouds. The artificial window 15 includes a frame 16 with four frame members 16*a*–16*d*. Typically, as box 17 incorporates the frame, and has side wall members 17*a*–17*d*, and rear wall member 31. The latter may fit against the room wall 11 and be mounted in position in any manner desired. See for example mounting brackets 18, which may be concealed as shown. The eye of an observer looking at the artificial window 15 from within the room appear at 19. Box 17 does not communicate with the exterior and is not installed in the wall 11, so it can be installed anywhere on the wall.

More specifically and extending the description to FIG. 2, box walls bound an interior space 21, which faces or opens longitudinally forwardly in the direction of arrow 22. Translucent sheet means S are carried by the box to extend crosswise of space 21. Such sheet means may include, for example, first and second translucent sheets 23 and 24, seen in FIG. 3, sheet 23 located forwardly of sheet 24, and sheet 23 being transparent, whereas sheet 24 is translucent or light diffusing. Both may consist of glass, or plastic material (synthetic resin).

Located between the sheets 23 and 24 is a viewable pattern means 25 shown in sheet form, and which may for example consist of a plastic film (which may be locally transparent, translucent or opaque) on which a pattern in the form of a scene (black and white or colored for example scene 20) is affixed, to be illuminated by light rays traveling forwardly in the box interior. Both sheets 23 and 24 may be the same, i.e., transparent, and an additional sheet 26 may be provided at the rear of 24, to provide light diffusion, i.e., sheet 26 may be translucent. All the sheets may be generally edgewise co-terminous for support by box structure indicated at 30.

A light source is provided in the window box, rearwardly of the sheet means. A reflector means is also provided in the box to reflect light from the light source means in a direction toward the sheet means for effecting illumination (for example back illumination) of the viewable pattern means, as referred to. In the simplest embodiment, the rear of the flat box 31 acts as basic reflector to provide such illumination. In an improved version, a curved reflector as at 36 is employed. A laterally horizontally elongated fluorescent lamp 35 is spaced forwardly of the elongated central region **36*a* of the laterally elongated reflector 36. The latter may comprise a metallic sheet, having like laterally vertically spaced and curved sections 36*b* and 36*c* to reflect light as shown. See rays 37 and 38 transmitted rearwardly and laterally for reflection at 37*a* and 38*a*, and subsequent travel at 37*b* and 38*b* to a diffuser plate 39. The latter diffuses the rays so that they then travel forwardly at 37*c* and 38*c* to illuminate the sheet means, as referred to above. Thus, all or substantially all light used for illumination may be reflected from the reflector 36, and provision is made for uniform, or substantially uniform illumination of the viewable pattern means 25. Alternatively, the diffuser sheet 39 may be forward and associated with sheets 24, 25, and 26**.

Figure 4:
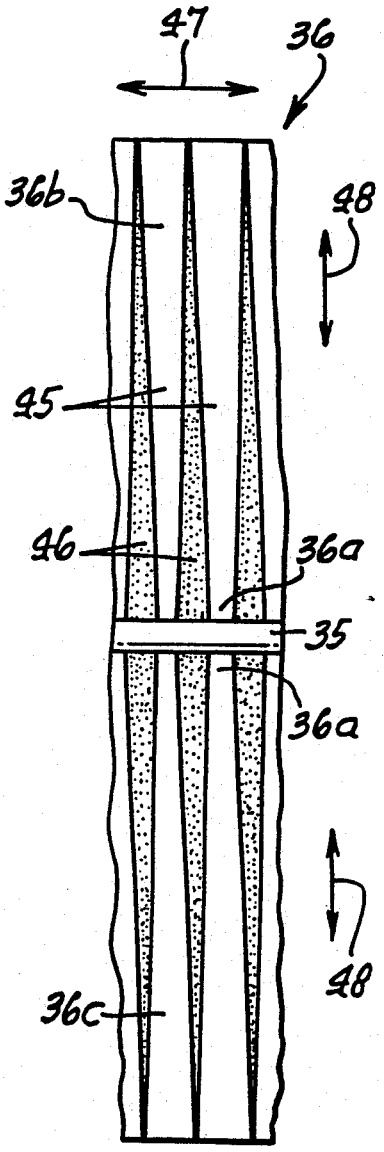
FIG. 4 is a plan view of a reflector employed in FIG. 3 looking toward the reflecting surface.

In this regard, means is provided in association with at least one of the elements 24 and 26, and 36, for controlling the illumination of the viewable pattern means, as a function of at least one lateral dimension of such element or elements, thereby to obtain the desired uniform, or substantially uniform, illumination of the pattern means 25. As one example, reference is made to FIG. 4 showing that reflecting portions of the surface structure of the reflector 26 are modified to enhance illumination of portions of the pattern 25 that would otherwise receive lesser illumination. See portion 45 of the surface of 26, between darkened or shaded (light absorbing) zones 46. Zones 46 are spaced apart along laterally horizonal dimensions 47 of the reflector, and are elongated along shallowly, vertically curved, lateral dimensions 48 of the reflector, and also tapered away from the central region **36*a* of the reflector rearwardly of the bulb 35. Zones 45 progressively widen in directions 48 away from 36*a*, as shown. FIG. 4** may also be considered to represent a flat reflector.

Other means to achieve uniform illumination include: variable shading on a transparency (transparency sheet) placed adjacent or incorporated into sheet 25, and variable thickness of the diffuser sheet 39 (i.e., increasing thickness of 39 in opposite directions away from the plane 52 that bisects the sheet 26 and that bisects bulb 35, as well as extending forwardly, as shown.

FIG. 5 shows light-absorbing, black dots on the surface of the reflector 36, the density of such dots progressively decreasing in a direction 48 away from the central zone **36*a* of the reflector rearward of bulb 35. Thus, more light is absorbed at zone 53 than at zone 54, for example, zone 54 being closer to the edges of the plates 23–25 than zone 53. The light-reflecting surface of the reflector may, therefore, be likened to a variable areal density white paint. Alternatively, such a pattern 53 and 54 may be associated with the diffuser 39 or sheets 26 or 24**. Such a dot pattern here may be either white (reflective) or black (absorbing).

Also provided are means for illuminating the edges of the sheets 23, 24, and 26, or a selected edge or edges of such sheets. See edges **23*a*, 24*a*, and 26*a* in FIG. 3 in the path of light from an elongated electric lamp 55 extending parallel to such edges. A reflector 56 is provided to the rear of that lamp, and circuitry 57 is connected with the lamp to control its illumination. Such circuitry may include a "dimmer"; for example, variable electrical resistance that increases with time so that the light source 55 is progressively dimmed, thereby to reduce the daylight effect of light transmitted into the sheet and parallel to the plane thereof. Thus, a fading daylight effect is created. Note the control circuit 58 connected to and controlling circuitry 57. Similar circuits 57*a* and 58*a* may be provided to similarly create energization of source 35**, a shown.

The plates 23 and 24 may consist of plastic material, such as acrylic, and may bear appropriately positioned surface scratches, at surfaces facing forwardly or rearwardly, to locally emit light transmitted from 55 for creating highlighting effects, as for example simulated stars, and sunrise and sunset color streaks in the sky. See scratches at 60 in FIG. 1 which may also represent "star" zones for very short scratches.

Controls 58 and **58*a* may provide illumination sequencing, as in a "light filter", to provide viewable effects, such as oncoming sunrise, sunset and evening. Sun, moon, stars, and night colors (dark blue for example), and clouds may also be provided in this or similar manner. The edges of sheets 24 and 26 may be colored dark blue to produce night light, or orange to produce sunset or sunrise. The movable shutter 250** may allow or cut off light passage to either sheet.

FIG. 6 shows the provision of a light filter sheet 64 parallel to sheets 23 and 24, and adjacent to one or the other thereof. Multiple reflectors **36*d* and light sources 35*d* may also be employed, as in FIG. 7**.

Figure 3:
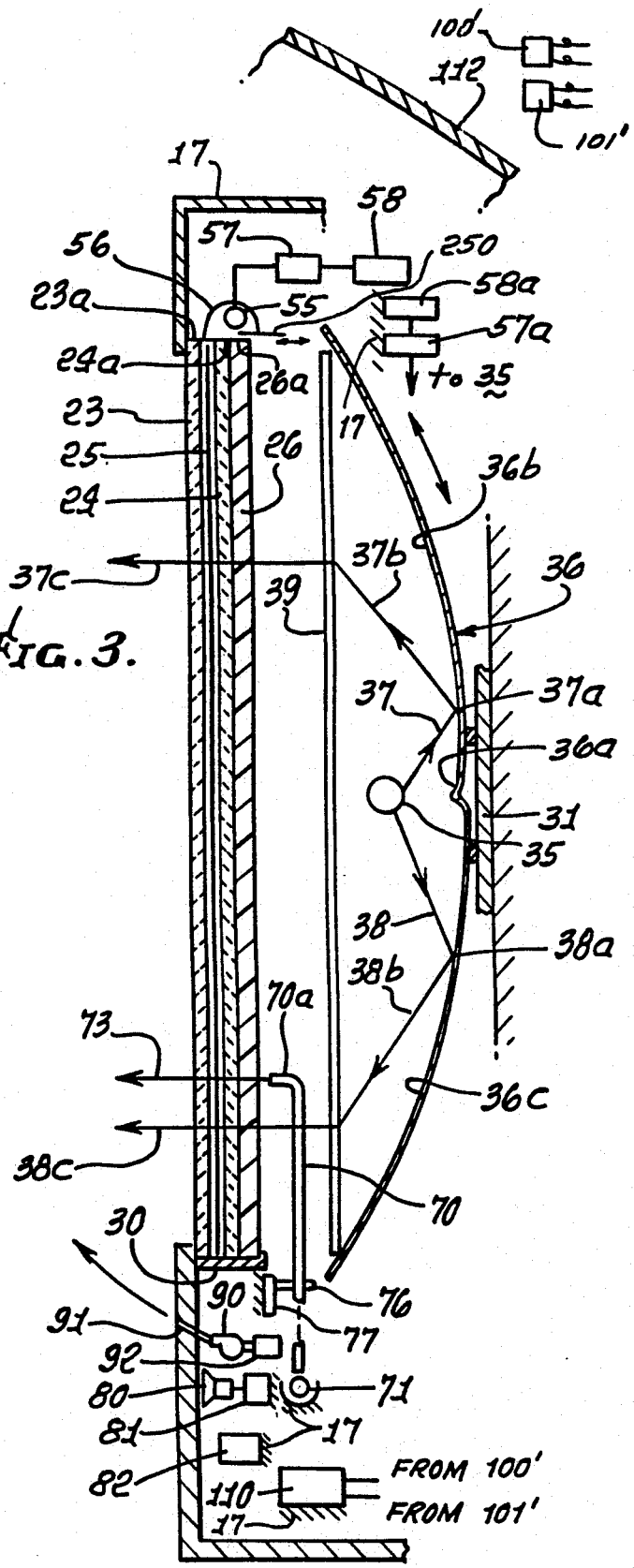
FIG. 3 is a further enlarged section, related to FIG. 2, but showing greater detail.

FIG. 3 shows the provision of a light pipe 70 projecting between 39 and 26, and receiving light from a source 71. The forward end of the pipe is turned at **70*a* to project toward sheet 26, directly behind same, so that light is projected in rays at 73 to simulate a moon in a scene provided by the transparency. The pipe is carried to pivot at a shaft 76, an actuator 77 providing such pivoting of the shaft so that the turned end 70*a*** slowly translates across a sky associated with the transparency scene yielding a time-progress effect to the viewer.

The sun and moon are simulated by a bright light which arcs across the sky. The light emanates from ends of light pipes which pipe the light from bulbs to turned-up ends. The end of the pipe which simulates the moon may be caused to appear to go through "phases". The sky may be on the acrylic plastic sheet behind the light pipe so that there is not a blue filter over the sun and moon, or the color of the sun and moon may be adjusted to compensate for this "blue sky" filter.

Referring again to the dimmer means, the dimmer ballast is switched from operating the sunrise and sunset lights to the night sky and stars lights. These two sets of lights do not need to be on at the same time. The switch is less expensive than another set of dimmer ballast.

Also provided is sound-producing means associated with the pattern means (as for example thunder, dogs barking, etc.). See speaker 80 in the box and tape player 81 connected with same in FIG. 3. A sound generator 82 may be provided. Wind or air current-generating means may be provided, as by blower 90 and ducting 91 exhausting frontwardly toward the viewer to enhance the natural effect of a viewable scene in the window. A scent source (forest scent, etc.) may also be provided at 92 connected to the blower to supply scent to the displaced air. Other effects may be created, including strobe light and sound amplification.

The transparent film 25 may be attached to sheet 24, and the latter moved up and down, or tilted, controllably, to cause shifting of a horizon provided by the film 25. See FIG. 8 showing actuator or weight 100 connected at 101 to 24 for this purpose.

Additional effects may be provided as follows:

General Local Daylight Intensity

Variations in the window daylight, sun and moon intensity reheating exterior illumination levels caused mainly by clouds and the time of solar day. Thus, the viewer is informed of exterior conditions. For this purpose, an exterior photo sensor 100 may be used, as above roof or outer wall 112.

Lightning by Strobes

Lightning simulated by strobe lights.

Repetition of External Sounds

Rebroadcasting outside sounds by using an outside microphone 100'. This, as well as, signals relaying external lights from sensor 100', is transmitted to the artificial window by wire, optical fiber, or radio. See FIG. 3.

Vented Air

Air being vented from an air vent behind the window through a diffuser which emanates from an opening in the (open) window.

Recirculating Air

Room air recirculation, intakes at the edges of the window, for example beneath, with the output through the window.

Electronic Controller

The electronic controller incorporates stored values versus time. These values are used to control the various light banks and other features.

Controller

The various features are programmed versus time using stored digital values which are used to control light levels versus time, etc., using an analog to digital converter.

Normal Cycle and Rapid Cycle

The controller has a normal cycle and a rapid cycle. The rapid cycle is used to show the features of the window within minutes rather than hours.

A master controller for all other controls is indicated at 110 in FIG. 3.

FIG. 9 is a view showing a modified diffuser 39', which is like 39, but has progressively decreasing thickness in directions 48.

Figure 10:
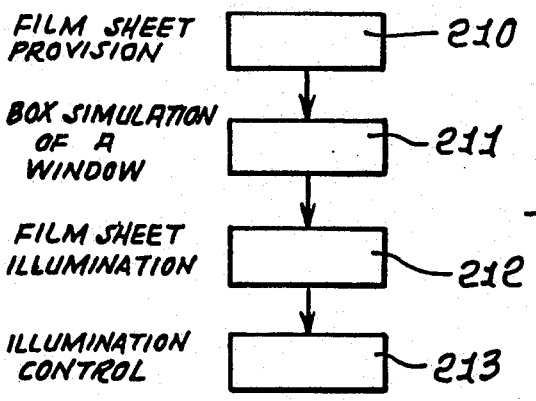
FIG. 10 is a flow diagram.
Figure 11:
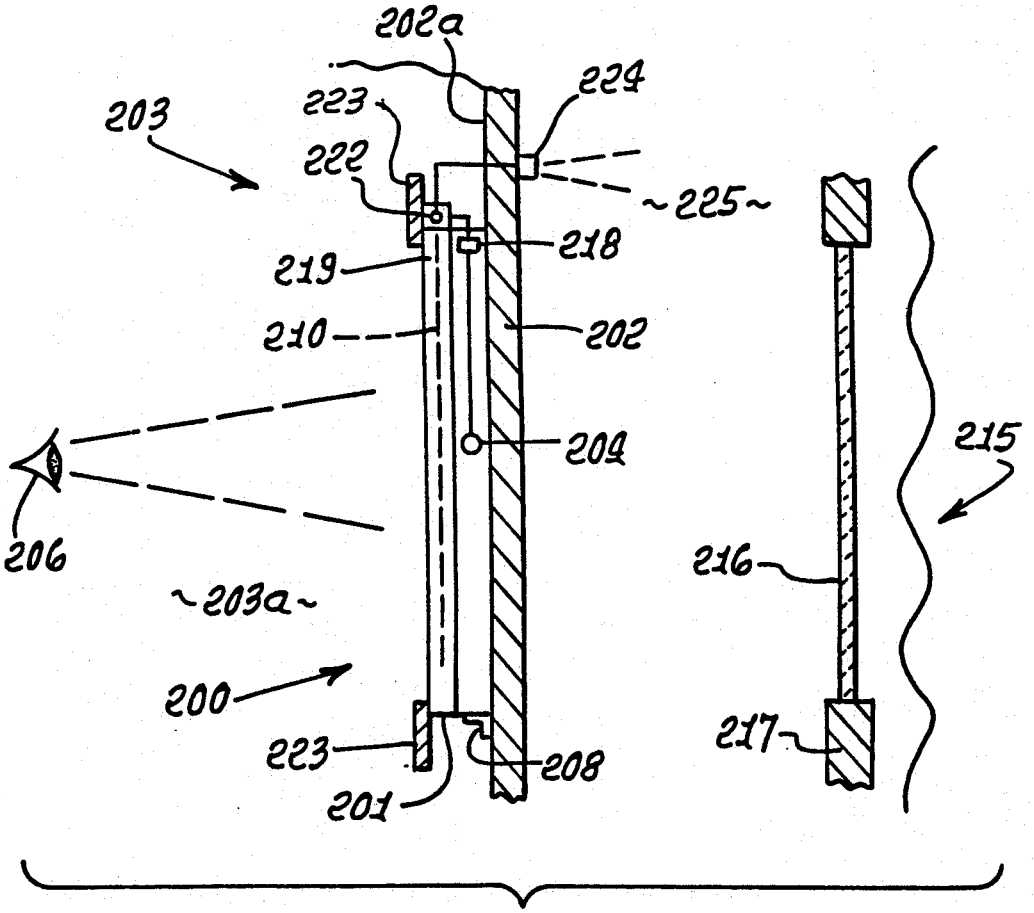
FIG. 11 is a schematic showing of operation of an artificial window associated with the steps of FIG. 10.

Referring now to the example described and shown in FIGS. 10 and 11, the method of forming and operating an artificial window includes the steps:

a) providing a film sheet that depicts a landscape (see step 210 in FIG. 10);

b) mounting the film sheet, as at 200, within a box 201, and supporting that box, as at 208, adjacent the inner side **202*a* of a wall 202 of a building room 203, to simulate a window in that wall from which the landscape might be viewed (see step 211 in FIG. 10**);

c) employing artificial light to provide illumination of the film sheet in such manner that, when viewed, as at 206, from the room interior **203*a*, the landscape is depicted, such illumination including back illumination as from a light source 204 in the box (see step 212 in FIG. 10**);

d) and controlling said illumination of the film sheet to simulate a selected time of day associated with the landscape (see step 213 in FIG. 10).

In this regard, the landscape depicted by the film sheet (for example a transparency upon which a landscape appears at colored opaque areas) may be a representation of the same landscape as could be viewed from the room through a window in wall 202. See for example landscape 215 to the right of wall 202, as might be viewed through a window 216 in a wall 217, then being representational only. Window 216 is shown aligned with window box 201 and the transparency 210, for purposes of illustration. The landscape depicted by the film sheet 210 may alternatively be different from that at 215.

The control of intensity of back illumination may for example be carried out in a controller 218 connected at 219 with 204, for example to control intensity or brightness of illumination. This, bright daylight, late daylight, and evening light can be successively programmed into such illumination, other light conditions also being effectable, as described above in earlier views. The d) step above also includes the option of providing a translucent light diffuser means, as at 219, proximate the film sheet, and transmitting light into the diffuser means or sheet 219, as via its edge or edges, to travel therein generally parallel to the plane of sheet 210. See light source 222, controlled as by 218, adjacent the edge of 219. A window box frame appears at 223.

A sensor 224 may be exposed to the exterior 225 of the room 203, to sense external light conditions, or other conditions, for controlling or modulating, via light source 204 and 222, and thus the illumination of the film sheet, as a function of such sensing. Thus, if the exterior sky darkens, the illumination of sheet 210 may be diminished, this being one example only.

Other aspects of the elements described and claimed, with alternatives are listed as follows:

Simulated window frame means can include the following components:

A frame which gives the viewer the appearance of a window on a wall.

The frame may be made of wood, plastic, steel, or structural type of material. The construction material may have a natural finish, painted, or other type of alternative finish.

The frame may have a sill and/or mullions to further enhance the illusion that the frame represents the frame of an actual window.

Such items as venetian blinds, drapes, curtains, etc., can be combined with the simulated window frame to give the viewer the further illusion of a real window.

The frame means will combine the viewable pattern means to the illumination means.

The frame might have attachment means to hang on the wall and contain the viewable pattern means and the illumination means with illumination control.

Viewable pattern means can include the following elements:

The viewable pattern may be a photographic transparency.

The viewable pattern may be a printed picture or some other picture means.

The viewable pattern may represent a scene in nature, in the country, in a garden, in a forest, by a body of water, of a city, etc.

A transparent glass or plastic material may be placed in front of the viewable pattern to protect it from damage, dust, dirt, foreign material, or the like.

The viewable pattern may be confined between two panes of glass, plastic, or similar sheet materials which permit the passage of light.

The viewable pattern may be attached to one or two pieces of glass, plastic, or similar sheet materials which permit the passage of light.

The viewable pattern may be more than one scene, with means being provided to change the picture from one scene to another.

Illumination means can include the following components:

incandescent lamp/lamps;

fluorescent lamp/lamps with necessary ballast/ballasts and possibly starter/starters;

neon lamp/lamps and necessary ballast/ballasts;

electroluminescent lamp system/systems;

liquid crystal display lighting system/systems;

combination of two or more of the above light source into the illumination means;

illumination means can have attachment means to the wall on which it will hang;

illumination means may work in combination with the simulated window frame and viewable pattern means to hang on a wall;

illumination means may have ability to support and position light source/sources in proper position with respect to viewable pattern means and the illumination control means in order to provide proper illumination.

Illumination control means can include elements which have a tendency to even out the intensity of the illumination means so the viewable pattern means is not disturbing with bright and dim lighted areas.

The glass or plastic sheet material positioned behind the viewable pattern means may be translucent and have variable thickness to diffuse the intensity of the illumination means.

A reflector/reflectors may be used in conjunction with the illumination means to better distribute the light more evenly over the full display area.

A variable density white (or black) paint pattern may be placed on the glass, plastic sheet or plastic film behind the viewable pattern means to even out the intensity of illumination means.

A tinted and/or reflective material may be placed between the illumination means and the viewable pattern means to provide a more even light intensity output to the viewable pattern means.

The transparency may be intentionally modified to absorb, reflect, and transmit light to compensate for uneven illumination.

Illumination control may encompass the following: sunrise and sunset colors may be localized in clouds and just above the horizon. Starlight is localized to come from a few points. These effects may be achieved by:

Edge illumination of sheets which are used as light pipes. Surfaces where light is to emanate may be roughened.

Other light pipes may be used to transmit light from sources to small areas, such as the sun and moon, and these may move across the window.

I claim:

1. An artificial window comprising in combination a) a box having a rear wall, and side walls bounding an interior space which faces longitudinally forwardly, b) sheet means extending laterally crosswise of said space, said sheet means including a generally transparent sheet defining a plane and having an edge, and forward and rearward facing sides, and viewable pattern means placed on the transparent sheet to be illuminated by light passing forwardly from the box interior space, c) first light source means in said interior space and located rearwardly of said pattern means for illuminating said rearward facing side of said transparent sheet, and second light source means located in facing alignment with said edge for illuminating said edge of said transparent sheet relative to the plane thereof, d) there being control means associated with said first and second light source means, for separately controlling both of said first and second light source means to independently, differentially and progressively change the illumination of the viewable pattern means, e) and there being additional means associated with said first light source means for causing substantial uniformity of its controlled illumination of the rear ward facing side of said transparent sheet over the major area of said transparent sheet, and f) said sheet means also including first and second translucent sheets at the forward and rearward sides of said generally transparent sheet, said second light source means directly facing edges of at least one of the translucent sheets and said generally transparent sheet.

2. The combination of claim 1 including time sequencing light filter means associated with said second light source and said sheet means for providing a viewable effect characteristic of at least one of the following effects associated with said pattern means sun moon stars night colors.

3. The combination of claim 1 including a light transmitting pipe rearwardly of and proximate said sheet means to produce a local light spot associated with said viewable pattern means.

4. The combination of claim 3 including at least one of the following associated with said second light source means light filter light shutter
light dimmer.

5. The combination of claim 1 including means associated with said first and second light source means for producing at least one of the following viewable effects associated with said pattern means:
general lighting
night
dawn
sunrise
partial day
full day
sunset
dusk
illumination intensity
illumination color.

6. The combination of claim 1 including sound-producing means associated with said viewable pattern means.

7. The combination of claim 6 wherein said sound-producing means includes means for reproducing natural sounds occurring outside a building from within which said pattern means is viewable.

8. The combination of claim 1 including means associated with said viewable pattern means for producing a viewable moving horizon.

9. The combination of claim 1 including means for producing viewable, movable light means associated with said pattern means.

10. The combination of claim 1 including means supporting said box so that said pattern means is viewable from a position inside a building, said pattern means defining a picture.

11. The combination of claim 1 including scent-producing means associated with said viewable pattern means.

12. The combination of claim 1 including means for displacing air from a locus associated with said viewable pattern means.

13. The combination of claim 1 wherein said additional means for causing said substantial uniformity of illumination of said pattern means includes at least one of the following within said box:
reflecting structures shaped to enhance illumination of lesser illuminated portions of the pattern means,
variable light-absorbing zones associated with said sheet means,
variable shading of said pattern means, on a transparency,
variable thickness of a diffuser sheet associated with said sheet means;
variable light reflecting zone associated with said sheet means.

14. The combination of claim 1 wherein said means for causing said substantial uniformity of illumination of said viewable pattern means includes a light reflector with said box and light-absorbing zones on said reflector, and which decrease in width, areal density or light absorbing capacity in directions away from said first light source means.

15. The combination of claim 1 wherein said additional means includes light reflector means in or associated with said box, and first light source means includes at least one light-transmitting bulb.

16. The combination of claim 15 wherein said reflector means is positioned to reflect light from said bulb in a direction toward said sheet means for effecting said illumination of the sheet means.

17. The combination of claim 16 wherein said reflector means has a curved surface to reflect said light.

18. The combination of claim 17 wherein said bulb is elongated and extends generally normal to said lateral dimension.

19. The method of forming and operating an artificial window, that includes
a) providing a box having a rear wall, and side walls bounding an interior space, and orienting the box so said space faces longitudinally forwardly,
b) providing sheet means and orienting said sheet means to extend laterally crosswise of said space, said sheet means including a generally transparent sheet having forward and rearward sides and having an edge, there being viewable pattern means placed on the transparent sheet to be illuminated by light passing forwardly from the box interior, and said sheet means further including first and second translucent sheets at forward and rearward sides of said transparent sheet and having edges,
c) providing first light source means rearwardly of said sheet means and oriented in or associated with said box so that said light passes forwardly to illuminate said pattern means substantially uniformly over the major area thereof, and providing second light source means in facing alignment with said edges of said transparent sheet and at least one translucent sheet for illuminating said edges causing light to pass edgewise into said sheet means,
d) controlling said first and second light source means independently to independently, differentially and progressively change the resultant illumination of the viewable pattern means,
e) and providing additional means associated with said first light source means for causing substantially uniformity of its controlled illumination of the rearward facing side of said transparent sheet over the major area of said transparent sheet.

20. The method of claim 19 that includes
e) said pattern means provided to depict a landscape, which is illuminated by both of said light source means,
f) supporting said box adjacent an inner side wall of a building room, to simulate a window in that wall from which the landscape might be viewed,
g) and controlling said first and second light source means to control said illumination to simulate a selected time of day associated with said landscape.

21. The method of claim 20 wherein said landscape depicted by the pattern means is the same landscape as could be viewed from said room through a window in said wall.

22. The method of claim 20 wherein said landscape depicted by said pattern means is different from the landscape that could be viewed from said room through a window in said wall.

23. The method of claim 20 wherein said controlling of the first and second light sources includes controlling the intensity of said illumination.

24. The method of claim 20 which includes sensing external light conditions outside said room, and controlling said illumination as a function of said sensing.

25. The method of claim 19 wherein said controlling step includes maintaining said substantial uniformity of area illumination of said sheet means from said first light source, during said progressive change of said illumination.

* * * * *